US005743023A

United States Patent [19]

Fay et al.

[11] Patent Number: 5,743,023

[45] Date of Patent: Apr. 28, 1998

[54] METHOD AND APPARATUS FOR CONTROLLING FREEZE DRYING PROCESS

[76] Inventors: John M. Fay, 1517 Long Pond Dr., Warrington, Pa. 18976; Donald S. Finan, 8616 W. 121st St., Palos Park, Ill. 60464

[21] Appl. No.: 709,027

[22] Filed: Sep. 6, 1996

[51] Int. Cl.[6] ..... F26B 13/10

[52] U.S. Cl. ..... 34/287; 34/538; 34/570; 34/92; 34/527; 34/417

[58] Field of Search ..... 34/527, 538, 570, 34/92, 284, 287, 417; 62/51.1, 201

[56] References Cited

U.S. PATENT DOCUMENTS 3,795,986 3/1974 Sutherland et al. ..... 34/92
4,016,657 4/1977 Passey ..... 34/92
4,081,914 4/1978 Rautenbach et al. ..... 34/92
4,547,977 10/1985 Tenedini et al. ..... 34/92 X
5,456,084 10/1995 Lee ..... 62/51.1
5,519,946 5/1996 Renzi ..... 34/239

*Primary Examiner*—Henry A. Bennett
*Assistant Examiner*—Steve Gravini
*Attorney, Agent, or Firm*—Olson & Olson

[57] ABSTRACT

Control of temperature of the shelves in a freeze dryer compartment is achieved by circulating a cooled heat transfer fluid from a heat exchanger through a vacuum condenser independently of circulating the cooled heat transfer fluid either directly through the passageway chambers in the freeze dryer shelves, for cooling the shelves, or through a heater for heating the shelves. These circulations are effected by the selective control of electrically operated valves in fluid conduits automatically by a programmed computer.

11 Claims, 1 Drawing Sheet

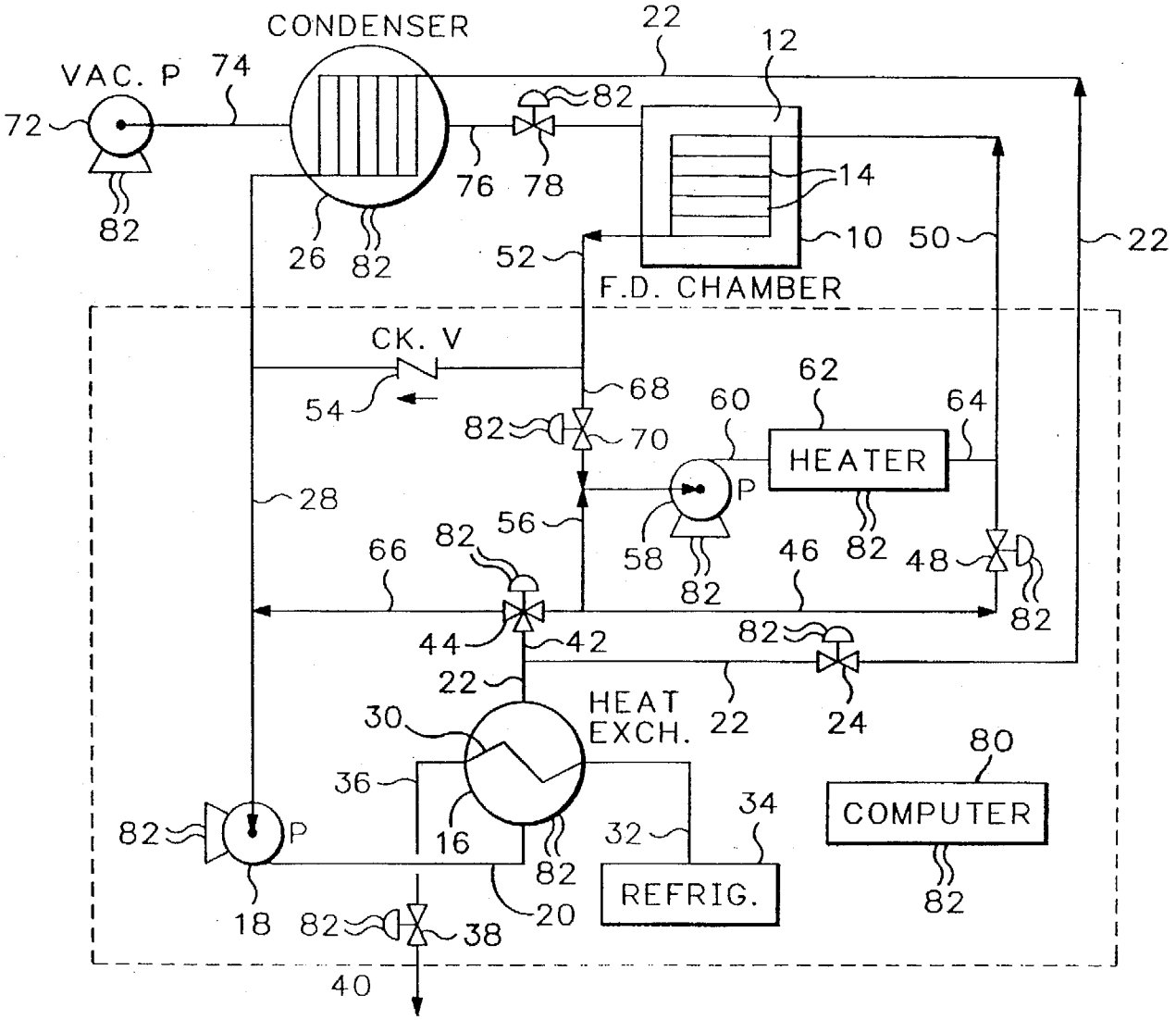
CONDENSER
VAC. P
F.D. CHAMBER
HEATER
CK. V
HEAT EXCH.
COMPUTER
REFRIG.
P
P

METHOD AND APPARATUS FOR CONTROLLING FREEZE DRYING PROCESS

BACKGROUND OF THE INVENTION

This invention relates to freeze drying, and more particularly to method and apparatus for improving the precision and efficiency of freeze drying.

It has been the procedure heretofore to utilize a separate flow of liquid nitrogen, or other refrigerant, for the condenser and for the main heat exchanger of a freeze dryer or other refrigeration system. This results in uneven temperatures in the condenser, due to the phase change flashing of the refrigerant.

SUMMARY OF THE INVENTION

The method and apparatus of this invention utilizes a single heat exchanger, cooled by a cryogenic refrigerant, to deliver cold heat transfer fluid directly to a condenser and, independently, to a freeze dryer or other refrigeration system, either directly or through a heater circuit, for cooling or heating the freeze dryer.

It is the principal objective of this invention to provide a method and apparatus which overcomes the aforementioned limitation and disadvantages of prior freeze dryer control systems.

Another objective of this invention is the provision of a method and apparatus of the class described by which independent flow of heat transfer of fluid to the condenser and to the freeze dryer results in precisely controlled temperature for vacuum drying.

Still another objective of this invention is to provide a method and apparatus of the class described by which high temperature flow of heat transfer fluid to the freeze dryer may occur simultaneously but independently of flow of cold temperature heat transfer fluid to the condenser.

Another objective of this invention is to provide a method and apparatus of the class described in which the liquid refrigerant is isolated from the heat transfer fluid, whereby the gaseous phase of the liquid refrigerant is not contaminated.

A further objective of this invention is the provision of a method and apparatus of the class described which involves a simplified structural arrangement for economical manufacture, maintenance and repair, and accommodates incorporation into existing freeze dryer systems.

The foregoing and other objects and advantages of this invention will appear from the following detailed description, taken in connection with the accompanying drawing of a preferred embodiment.

BRIEF DESCRIPTION OF THE DRAWING

The single FIGURE is a schematic flow diagram illustrating method and apparatus embodying the features of this invention.

DESCRIPTION OF THE PREFERRED EMBODIMENT

The drawing shows a refrigeration system in the form of a freeze dryer housing 10 providing a compartment 12 in which a plurality of shelves 14 serve to support material to be freeze dried. The process of freeze drying involves the selective heating and cooling of the shelves and the condenser surface, and it is to this requirement that this invention is directed. The apparatus illustrated is confined within the broken boundary lines.

In accordance with this invention, heating and cooling of the freeze dryer shelves 14 is accomplished by use of a heat transfer fluid such as "LEXSOL", a product of Santa Barbara Chemical Company, D'Limonene, available from Florida Chemical Company, Silicone Oil, or other equally suitable fluid. The fluid is contained in a circulation system of passageways and tubings which include a continuous passageway in a heat exchanger 16. The inlet of the passageway communicates with the outlet of a fluid pump 18 through conduit 20. The outlet of the heat exchanger passageway communicates through conduit 22 and valve 24 with the inlet of a continuous passagway in a vacuum condenser 26. The outlet of the passageway and the condenser communicate through conduit 28 with the return side of the fluid pump 18.

The heat exchanger 16 includes a continuous passageway 30 having an inlet end communicating through conduit 32 with a source 34 of refrigerant, such as liquid nitrogen. The outlet end of passageway 30 communicates through conduit 36 and electrically operated modulating control valve 38 with a recovery system 40 by which the gaseous phase of the liquid refrigerant may either be returned to liquid form for recycling to source 34, or it may be used as a gas in other processes such as purge gas or vacuum breaker. The gaseous phase is an uncontaminated source available under pressure for secondary use, because it is never in direct contact with the heat transfer fluid.

In the well known manner of heat exchangers, the passageway 30 is in heat conductive association with the passageway carrying the heat transfer fluid, whereby the latter is cooled by the refrigerant in passageway 30.

The outlet of the heat exchanger passageway also communicates through conduit 42 and three-way electrically operated modulating control valve 44 and conduit 46, valve 48 and conduit 50, with the inlet end of the continuous passageway chambers in the freeze dryer shelves 14. The outlet end of the passageway in the shelves communicates through conduit 52 and check valve 54 with the conduit 28 for return to the pump 18.

The conduit 46 also communicates through conduit 56 with the inlet of fluid pump 58. The outlet of this pump communicates through conduit 60 with the inlet of a passageway through an electrical heater 62. The outlet of the heater communicates through conduit 64 with conduit 50 leading to the inlet end of the passageway in the freeze dryer shelves 14.

Conduit 66 communicates the outlet conduit 42 of the heat exchanger 16 through electrically operated modulating control valve 44 with conduit 28 and the return side of pump 18. Conduit 68 and valve 70 communicate conduit 52 from the freeze dryer shelves 14 with conduit 56 leading to the inlet of pump 58.

Vacuum pump 72 communicates through conduit 74 with the vacuum condenser 26 which, in turn, communicates through conduit 76 and valve 78 with the compartment 12 of the freeze dryer housing 10.

The operation of the system described hereinbefore is as follows: To reduce the temperature of the shelves 14 in the freeze dryer, electrically operated modulating control valve 44 is operated to communicate conduit 42 with conduit 46. Valve 48 is opened to conduct cooled heat transfer fluid from the heat exchanger 16, through conduits 42, 46 and 50 to the passageways in shelves 14, thence out through conduit 52 and check valve 54 to conduit 28, for return to pump 18.

With the heat exchanger 16 being supplied with liquid nitrogen or other refrigerant from supply 34 and with pump 18 activated to circulate heat transfer fluid, valve 24 is opened to circulate heat transfer fluid through conduit 22 and the plates of condenser 26, thence through conduit 28 back to the return side of pump 18. Reduced pressure in the condenser is achieved by operation of vacuum pump 72, and valve 78 is opened to evacuate the freeze dryer compartment 12.

To elevate the temperature of the shelves 14, valve 48 is closed. Cooled heat transfer fluid from heat exchanger 16 thereby is conducted, as required, through conduit 56 and activated pump 58, thence through conduit 60, electrical heater 62 and conduit 64 to conduit 50. Cooling is thereby achieved by use of the inner loop described hereinafter, as required. The heated heat transfer fluid thus is delivered through the passageways in the freeze dryer shelves 14 to conduit 52. By opening valve 70, the heat transfer fluid from the shelves may be recycled through pump 58 and heater 62 to the shelves 14. When heating of the shelves is no longer required, pump 58 deenergizes and valve 70 closes.

Cool heat transfer fluid may be delivered to the shelves 14 either through the outer loop of conduit 46, valve 48 and conduit 50, or through the inner loop of conduit 56, pump 58, inactive heater 62 and conduit 64 to conduit 50. Thus, the inner loop through pump 58 and heater 62 may function to cool down, hold, and warm up the freeze dryer shelves, all independently of the circulation of heat transfer fluid through the condenser 26.

All of the valves shown in the drawing, with the exception of check valve 54, preferably are electrically operated valves controlled on a timed, temperature, or other predetermined basis by a programmed computer 80 connected to the valves, pump motors and other electrically operated components, through electrical conductors 82.

From the foregoing it will be appreciated that the two pump system of this invention allows for independent flow of heat transfer fluid to the plates of condenser 26 and results in precisely controlled temperatures of the freeze dryer shelves 14.

It will be apparent to those skilled in the art that various changes may be made in the size, shape, type, number and arrangement of parts described hereinbefore. For example, although the freeze dryer system described hereinbefore utilizes the chambers in the hollow shelves as part of the conduit system by which heat transfer fluid is circulated through the system, other refrigeration systems may utilize hollow wall panels, coiled piping, or other forms of chambers in the conduit system for the heat transfer fluid. Various well-known refrigerants and heat transfer fluids may be utilized, as desired. The types of control valves described for use in the conduit system may be replaced with other suitable types. The foregoing and other changes may be made without departing from the spirit of this invention and the scope of the appended claims.

We claim:

1. Apparatus for controlling the temperature of the chamber of a refrigeration system having a passageway therethrough for heat transfer fluid, the apparatus comprising:

a) a vacuum condenser communicating with the chamber and having a passageway therethrough for heat transfer fluid, b) a heat exchanger for cooling a heat transfer fluid in a passageway through said heat exchanger, c) first conduit means for circulating heat transfer fluid through the passageway in the heat exchanger and condenser, d) second conduit means for circulating heat transfer fluid through the passageways in the heat exchanger and chamber, independently of the circulation of heat transfer fluid through the condenser, and e) fluid pump means in the first and second conduit means for circulating heat transfer fluid through said first and second conduit means.

2. The apparatus of claim 1 wherein the refrigeration system chamber includes passageways in a plurality of shelves in the refrigeration system.

3. The apparatus of claim 1 including electrically operated valve means in the first and second conduit means for controlling the circulation of heat transfer fluid therein, and programmed computer means connected to said valve means for controlling operation of said valve means.

4. The apparatus of claim 1 including a) heater means for heating heat transfer fluid and having a passageway therethrough for heat transfer fluid, b) third conduit means for circulating heat transfer fluid through the passageway in the heat exchanger, heater and chamber, independently of the circulation of heat transfer fluid through the condenser, and c) valve means in said first, second and third conduit means for controlling the circulation of heat transfer fluid therein.

5. The apparatus of claim 4 wherein the refrigeration system chamber includes passageways in a plurality of shelves in a freeze dryer, and the valve means comprise electrically operated valves, and programmed computer means is connected to said control valves for controlling operation of said valves.

6. The method of controlling the temperature of a chamber of a refrigeration system having a vacuum condenser operatively associated therewith, the method comprising:

a) circulating cooled heat transfer fluid through a first conduit by fluid pump means through the vacuum condenser, and b) circulating cooled heat transfer fluid through a second conduit by fluid pump means through the chamber independently of the circulation through the vacuum condenser, for cooling the interior of the chamber.

7. The method of claim 1 including circulating heat transfer fluid by fluid pump means through a heater and thence through the interior of the chamber independently of the circulation through the vacuum condenser, alternately with said circulating cooled heat transfer fluid through the interior of the chamber, for heating the interior of the chamber.

8. The method of claim 6 wherein the circulating of heat transfer fluid through the refrigeration system chamber is by passageway chambers in shelves in the refrigeration system.

9. The method of claim 6 wherein the refrigeration system has operatively associated therewith a heat exchanger for cooling a heat transfer fluid, and the circulating of cooled heat transfer fluid is through said heat exchanger.

10. The method of claim 6 wherein the circulating of heat transfer fluid is through conduits having electrically operated valves controlled by a programmed computer.

11. The method of claim 6 wherein the circulating of heat transfer fluid through the refrigeration system is by passageway chambers in shelves of a freeze dryer, the refrigeration system has operatively associated therewith a heat exchanger for cooling the heat transfer fluid, the circulating of cooled heat transfer fluid is through said heat exchanger, heat transfer fluid also is circulated through a heater and said shelves for heating said shelves alternately with said circulating of cooled heat transfer fluid for cooling said shelves, and the circulating of heat transfer fluid is through conduits having electrically operated valves controlled by a programmed computer.

* * * * *